US007077241B1

(12) United States Patent
Liebetrau et al.

(10) Patent No.: US 7,077,241 B1
(45) Date of Patent: Jul. 18, 2006

(54) ELEVATOR INSTALLATION WITH FLAT-BELT-TYPE SUSPENSION MEANS ARRANGED IN PARALLEL

(75) Inventors: Christoph Liebetrau, Menziken (CH); Alban Meier, Gränichen (CH)

(73) Assignee: Inventio AG, Hergiswil NW (CH)

( * ) Notice: Subject to any disclaimer, the term of this patent is extended or adjusted under 35 U.S.C. 154(b) by 0 days.

(21) Appl. No.: 11/178,788

(22) Filed: Jul. 11, 2005

(30) Foreign Application Priority Data

Jul. 17, 2004 (EP) ..... 04016913

(51) Int. Cl.
*B66B 11/04* (2006.01)
*B66B 11/08* (2006.01)
*B66B 7/08* (2006.01)
*B66B 7/10* (2006.01)

(52) U.S. Cl. ..... 187/266; 187/251; 187/252; 187/254; 187/411; 187/412

(58) Field of Classification Search ..... 187/266, 187/251, 252, 254, 264, 411, 412
See application file for complete search history.

(56) References Cited

U.S. PATENT DOCUMENTS 611,416 A * 9/1898 Reynolds ..... 187/411
1,861,908 A * 6/1932 Culp ..... 187/411
2,322,774 A * 6/1943 Polack ..... 187/254
5,533,595 A * 7/1996 Narumi et al. ..... 187/266
5,957,243 A * 9/1999 Root et al. ..... 187/266
6,341,669 B1 * 1/2002 St. Pierre et al. ..... 187/412
6,386,324 B1 * 5/2002 Baranda et al. ..... 187/254
6,488,123 B1 * 12/2002 Pitts et al. ..... 187/251
6,742,628 B1 * 6/2004 Bauer ..... 187/254
6,820,726 B1 * 11/2004 Ericson et al. ..... 187/411

FOREIGN PATENT DOCUMENTS

JP 05294584 A * 11/1993
WO WO 99/43593 9/1999
WO WO 9943591 A1 * 9/1999

* cited by examiner

*Primary Examiner*—Kathy Matecki
*Assistant Examiner*—Eric E. Pico
(74) *Attorney, Agent, or Firm*—Butzel Long

(57) ABSTRACT

In an elevator installation with an elevator car and a counterweight suspended and driven by several flat-belt-type suspension devices arranged in parallel, the suspension devices are arranged in parallel vertical planes that run diagonal to main horizontal axes of the counterweight and/or of the elevator car. Mounted on the counterweight and on the elevator car are suspension-sheave systems of which at least one comprises several suspension-sheave units which each have one suspension sheave and are arranged adjacent to each other, the suspension-sheave units being fastened to the counterweight and/or to the elevator car in such manner that the axles of the suspension sheaves are essentially horizontal and each are swivelable about one associated vertical axis.

12 Claims, 3 Drawing Sheets

Fig. 3
Fig. 4
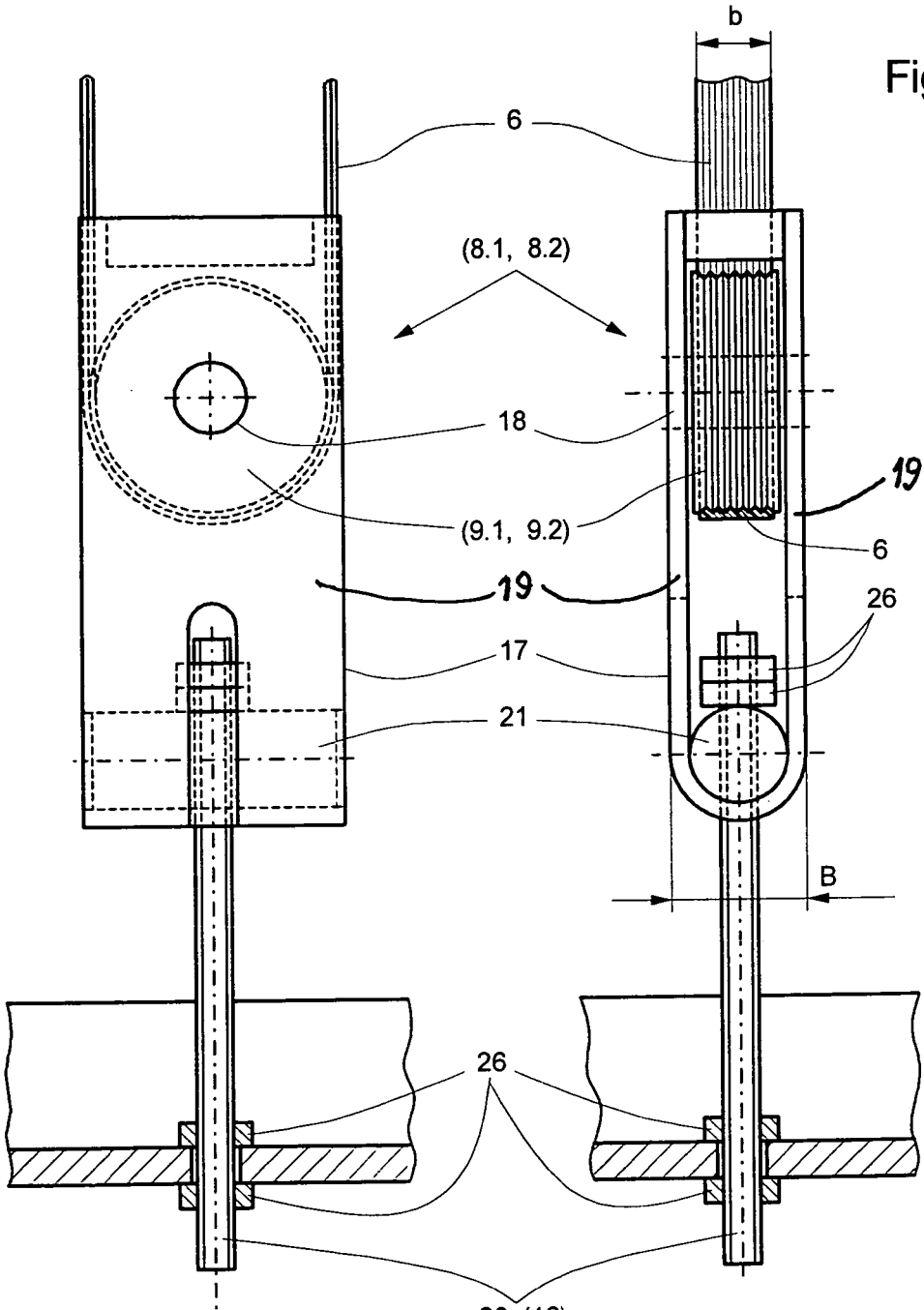
Fig. 5
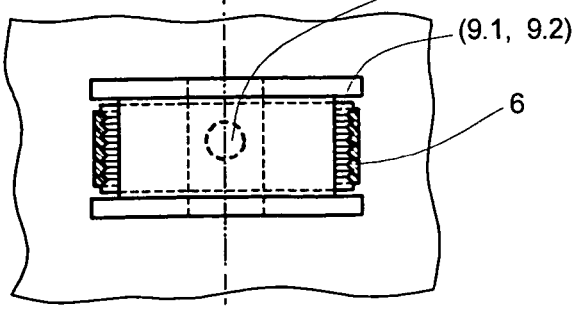

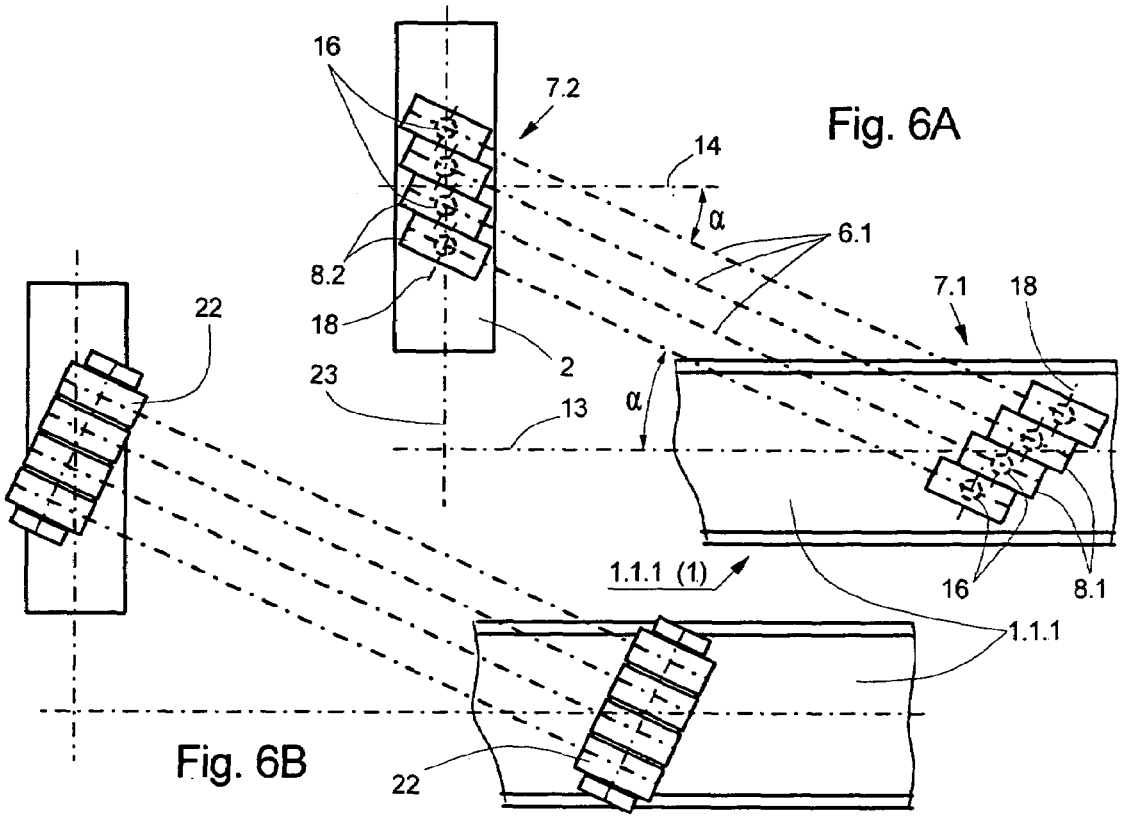
Fig. 6A
Fig. 6B
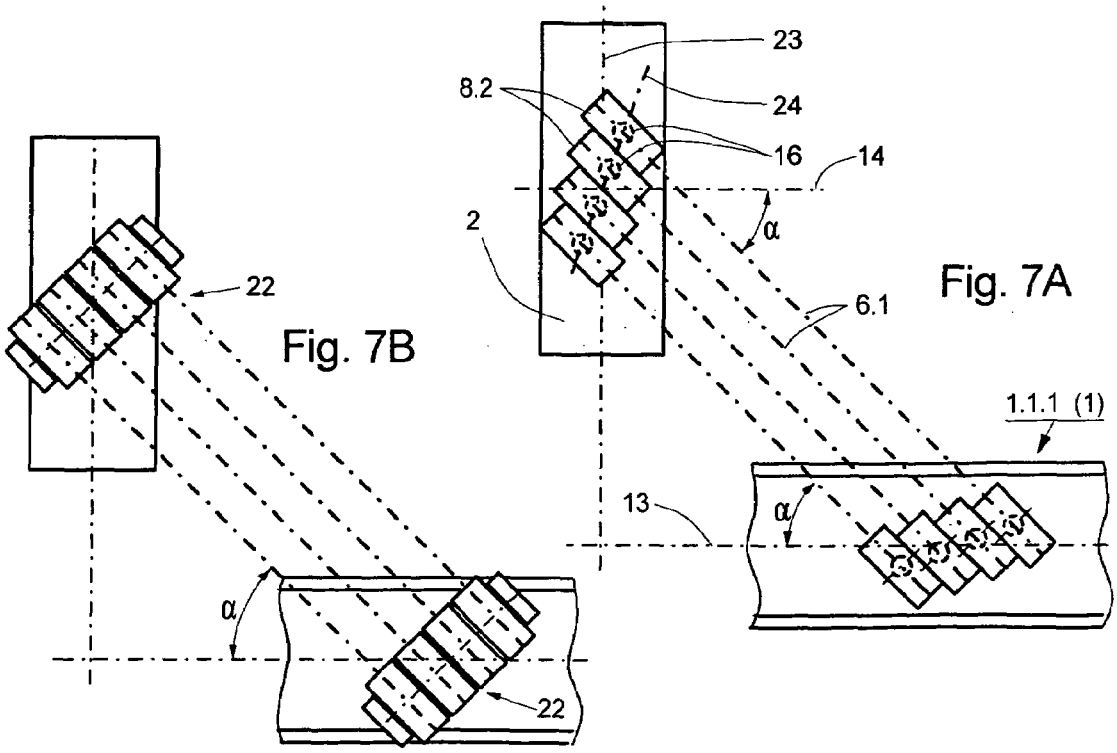
Fig. 7A
Fig. 7B

ELEVATOR INSTALLATION WITH FLAT-BELT-TYPE SUSPENSION MEANS ARRANGED IN PARALLEL

BACKGROUND OF THE INVENTION

The invention relates to an elevator installation which has an elevator car and a counterweight which are suspended and driven by flat-belt-type suspension means arranged in parallel. Present on the counterweight and/or on the elevator car are suspension-sheave systems which, together with a traction sheave and the suspension means, form a suspension system. This suspension system has a reeving factor of at least 2:1, and the suspension means, or more specifically their center lines, are arranged in parallel vertical planes which run diagonally to the main horizontal axes of the counterweight and/or of the elevator car.

From published International application WO 99/43593 an elevator system is known which has a drive motor arranged above, and in which the elevator car and the counterweight are suspended and driven by several flat belts arranged in parallel. FIG. 5 in WO 99/43593 shows an exemplary embodiment in which the flat belts which form the suspension means support the elevator car in the form of an undersling, the suspension means being arranged in parallel vertical planes which run diagonally to the main horizontal axes of the elevator car and of the counterweight, i.e. also diagonally to the walls of the elevator hoistway. The axles of the traction sheave, of the suspension sheaves mounted underneath the elevator car, and of the suspension sheaves on the counterweight, are aligned at right angels to the aforementioned planes of the suspension means and therefore also diagonally to the aforementioned main axes of the elevator car and of the counterweight.

An elevator car as disclosed in FIG. 5 of WO 99/43593 has a disadvantage as described below.

Passed around the suspension sheave present on the counterweight are several flat belts arranged in parallel, which can have the consequence that the suspension sheave must have a width which is substantially greater than the width of the counterweight. Because of the diagonal alignment of the suspension sheave axle relative to the main horizontal axes of the counterweight, which is necessary for the illustrated flat-belt suspension, the suspension sheave of the counterweight can require a building space which exceeds the width (thickness) of the counterweight. This prevents optimal utilization of the available hoistway cross section to accommodate a largest possible floor surface of the car, or requires for a given floor surface of the car a larger hoistway cross section.

SUMMARY OF THE INVENTION

A purpose of the present invention is to eliminate the aforementioned disadvantages of elevator installations which contain suspension sheaves on the counterweight and on the elevator car as well as several flat-belt-type suspension means arranged in parallel and in which the suspension means—more exactly their center lines—are arranged in several mutually parallel vertical planes which run diagonally to the horizontal main axes of the counterweight and/or of the elevator car.

The present invention is based on the idea of replacing the monolithic or single-axle suspension sheaves on the counterweight (and in certain cases also on the elevator car) which require too much building space by several suspension-sheave units which are arranged adjacent to each other and each of which has one suspension sheave, the suspension-sheave units being fastened to the counterweight and/or elevator car in such manner that the axles of the suspension sheaves are essentially horizontal and can each be aligned by swiveling about an associated vertical axis. By this means the problem can be avoided that a multi-suspension sheave consisting of one piece, or of several suspension sheaves arranged on the same axle, projects beyond the building space of the counterweight or cannot be built onto an elevator car in an available building space.

According to the preferred embodiment of the present invention, the suspension-sheave units are aligned in such manner that the suspension-sheave axles are at right angles to the parallel planes which run diagonally to the main axes of the counterweight and/or of the elevator car and in which the suspension means are arranged. Aligned in this manner, the axles of the suspension sheaves are mutually offset in the horizontal direction, with the result that the required building space for the suspension sheaves on the counterweight and/or for those on the elevator car can be minimized.

Particularly expedient is an embodiment of the present invention in which the suspension sheave of each suspension-sheave unit is mounted in bearings in a suspension-sheave housing which has an essentially rectangular horizontal cross section whose length is approximately the same as the diameter of the suspension sheave and whose width is not more than 150% of the width of the flat-belt-type suspension means. With such an embodiment it is guaranteed that the distance between the individual flat-belt-type suspension means can be kept as small as possible.

According to an expedient embodiment of the present invention, the vertical axes around which the suspension-sheave units can be swiveled are arranged on the counterweight and/or on the elevator car along a straight line and with distances between them which are so much greater than the width of the horizontal cross section of the suspension sheaves that the suspension-sheave housings can each be swiveled about their vertical axes through an angle of not more than 40° from their respective central positions before they prevent each other from moving further.

This makes it possible for the position of the suspension-sheave units to be adapted to elevator installations according to the present invention in which the angle between the parallel vertical planes containing the suspension means and the horizontal straight lines running at right angles to the horizontal straight lines and along which the vertical axes of the suspension means on the counterweight and/or on the elevator car are arranged are not greater than 40°.

An expedient further development of the present invention is that the vertical axes about which the suspension-sheave units can be swiveled have distances between them which are so much greater than the width of the horizontal cross section of the suspension-sheave housings that the suspension-sheave housings can each only be swiveled about their vertical axes through an angle of not more than 30° from their respective central positions before they prevent each other from moving further. Thanks to this limitation of the maximum possible swiveling angle of the suspension-sheave housings—and therefore of the suspension-sheave units—the distance between them—and therefore the distance between the flat-belt-type suspension means arranged in parallel—can be minimized, provided that the angles between the parallel vertical planes containing the suspension means and the horizontal straight lines which run at right angles to the horizontal straight lines along which the vertical axes of the suspension means on the counterweight and/or on the elevator car are arranged are not greater than 30°.

In a further embodiment of the present invention, the horizontal straight line along which the vertical axes of the suspension-sheave housings on the counterweight are arranged runs diagonally to the horizontal longitudinal axis of the counterweight. At a given distance between the flat-belt-type suspension means and the maximum swivel of the suspension-sheave housing which depends on that distance, an increase in the diagonality of the suspension-sheave units relative to the main horizontal axes of the counterweight and/or of the elevator car can be made possible, but a slightly larger building space is then required.

Advantageously, the suspension-sheave units are each fastened onto the elevator car and/or onto the counterweight by means of a tie-rod arranged approximately vertically, the tie-rod also forming the aforesaid vertical axis about which the suspension-sheave unit can be swiveled.

An expedient further development of the present invention consists of the tie-rod having at least one section with an external thread, it being possible for the external thread in conjunction with a screw part containing an internal thread to serve for adjustment of the tension in the associated suspension means. Tensioning means at the fastening points of the suspension means, which are usually arranged in a manner less well accessible for re-tensioning by maintenance personnel, can thereby be dispensed with.

In an especially advantageous embodiment of the present invention, the flat-belt-type suspension means are executed as V-ribbed belts. V-ribbed belts can be passed without problem over the traction sheave and over the suspension sheave and diverter sheave provided that these have on their periphery a V-ribbed profile complementary to the profile of the belt. Furthermore, the tractive force which can be transferred from the traction sheave to a belt is higher for V-ribbed belts than for a flat belt.

Depending on, for example, the hoistway space available in the hoistway headroom or in the hoistway pit, elevator installations according to the present invention can be executed with suspension sheaves mounted above the elevator car or executed with suspension sheaves underneath the elevator car—i.e. with so-called underslung suspension means as cited in the aforementioned state of the art.

DESCRIPTION OF THE DRAWINGS

The above, as well as other advantages of the present invention, will become readily apparent to those skilled in the art from the following detailed description of a preferred embodiment when considered in the light of the accompanying drawings in which:

FIG. 3 is an enlarged front elevation view of a suspension-sheave unit with a suspension-sheave housing and a suspension sheave arranged therein for a single flat-belt-type suspension means of the 2:1 reeving;

FIG. 4 shows the suspension-sheave unit according to FIG. 3 viewed in side elevation;

FIG. 5 is a top plan view of the suspension-sheave unit according to FIGS. 3 and 4;

FIG. 6A is a top plan view of the arrangement of suspension-sheave systems on the counterweight and the elevator car with individually swivelable suspension-sheave units, with a small angle between the plane of the suspension means and the main horizontal axes of the counterweight and the elevator car;

FIG. 6B is a top plan view of the arrangement of suspension-sheave systems as in FIG. 6A but with suspension sheaves on a common axle;

FIG. 7A is a top plan view of the arrangement of suspension-sheave systems as in FIG. 6A, but with a larger angle between the plane of the suspension means and the main horizontal axes of the counterweight and the elevator car respectively; and FIG. 7B is a top plan view of the arrangement of suspension-sheave systems as in FIG. 7A but with suspension sheaves on a common axis.

DESCRIPTION OF THE PREFERRED EMBODIMENT

Figure 1:
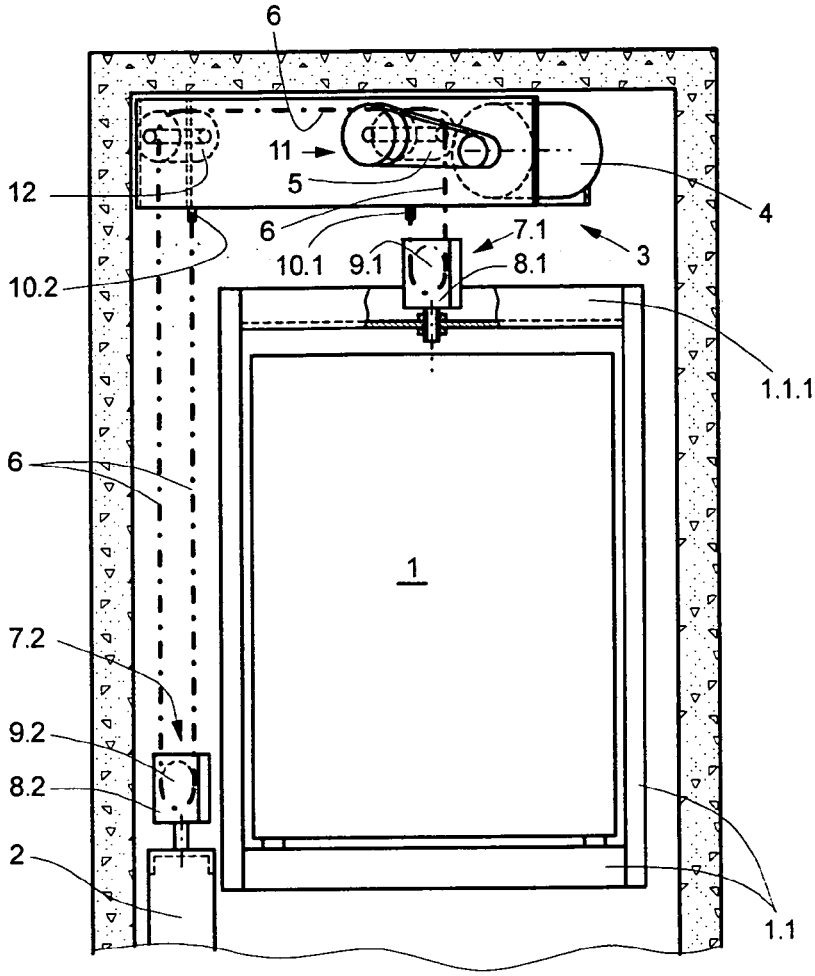
FIG. 1 is a schematic side view of an elevator installation according to the invention with a counterweight, a drive unit installed in the hoistway headroom, and a suspension means of a 2:1 reeving system.
Figure 2:
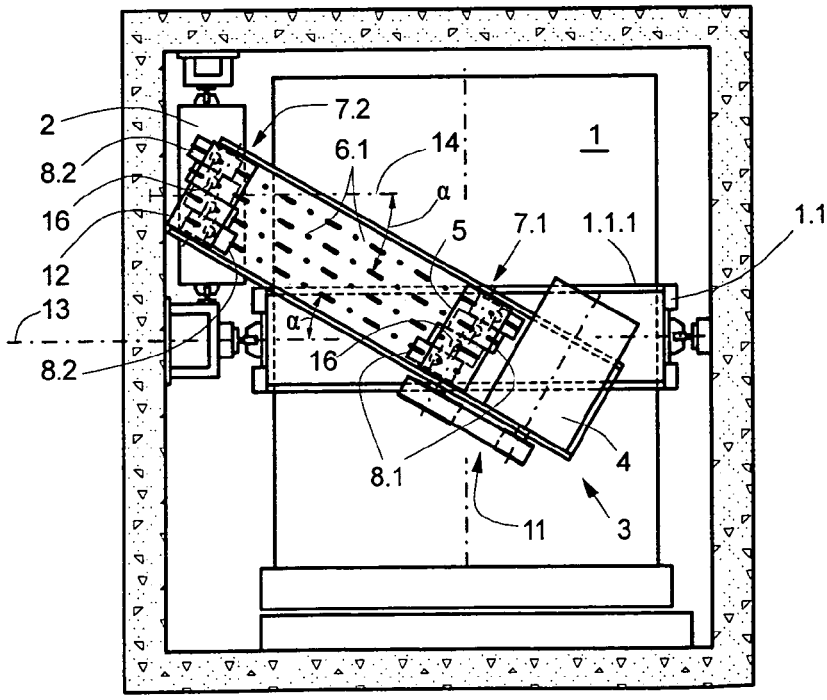
FIG. 2 is a schematic top plan view of the elevator installation shown in FIG. 1 with a drive and suspension-sheave systems as well as with the suspension means of the suspension system.

FIGS. 1 and 2 show a side view and a top plan view of an elevator installation according to the present invention. Shown in essence are an elevator car 1 with a car frame 1.1, a counterweight 2 installed at the side of the elevator car 1, and a drive unit 3 with drive motor 4 installed in the hoistway headroom of the elevator installation. The drive motor 4 drives via a belt pulley 11 a traction sheave 5 which acts on several flat-belt-type suspension devices or means 6 arranged parallel to each other (in the interest of greater clarity, in FIG. 1 only one single suspension means is shown). Indicated with reference numbers 7.1 and 7.2 respectively are suspension-sheave systems mounted on the crosshead 1.1.1 of the car frame 1.1 and on the counterweight 2, via which the flat-belt-type suspension means 6 suspend and drive the elevator car 1 and counterweight 2. From FIG. 1 it can be seen that, starting from a first suspension-means fastening-point 10.1 on the drive unit 3, the suspension means 6 pass over the suspension sheave 9.1 of the suspension-sheave system 7.1 mounted on the elevator car 1, are then passed upward to the traction sheave 5, pass over the traction sheave 5, extend approximately horizontally to a diverter sheave 12 of the drive unit 3, from here are passed downward to the suspension-sheave system 7.2 with the suspension sheaves 9.2 mounted on the counterweight 2, pass under the suspension sheaves 9.2 of the counterweight 2 and then terminate at a second suspension-means fastening-point 10.2 on the drive unit 3.

From the plan view (FIG. 2) it can be seen that the suspension devices or means 6 are arranged in parallel vertical planes 6.1 which run diagonally at an angle $\alpha$ to the main horizontal axes 13 and 14 of the elevator car 1 and of the counterweight 2 respectively. The aforesaid main axes also correspond approximately to the axes of gravity of the elevator car 1 and counterweight 2. Such an arrangement occurs in elevator installations in which the horizontal cross section of the counterweight is not placed symmetrically relative to a main axis of the elevator car, which is often the case for reasons of optimal space utilization.

As shown in FIG. 2, the counterweight 2 and elevator car 1 have suspension-sheave systems 7.2, 7.1 which do not contain either a monolithic suspension sheave or several suspension sheaves arranged on one single axle, but comprise several individual suspension-sheave units 8.2, 8.1 with integral suspension sheaves. These are fastened to the counterweight and elevator car in such manner that the suspension-sheave axles are horizontal and can each be swiveled about a vertical axis 16 assigned to each suspension-sheave unit 8.2, 8.1. In FIG. 2 the suspension-sheave units 8.2, 8.1 are only shown as rectangles which approximately mark the outline of the suspension sheaves and in which a small circle symbolizes the aforementioned vertical axes. The suspension-sheave units 8.2, 8.1 are, however, so swiveled and fixed that the suspension-sheave axles built into them are at right angles to the parallel vertical planes 6.1 in which the suspension means 6 are arranged. Furthermore, in the horizontal direction, the suspension-sheave axles are arranged offset to each other which allows the suspension-sheave systems 7.2, 7.1 to be placed within the vertical projection of the counterweight and/or within a crosshead 1.1.1 of the car frame 1.1 of the elevator car 1 respectively.

The construction of these suspension-sheave units 8.2, 8.1, their arrangement, and their advantageous effects are described in more detail below.

FIGS. 3, 4, 5 show a front view, a side view, and a top plan view of the suspension-sheave unit 8.2, 8.1. The suspension sheave 9.1, 9.2 designed for the flat-belt-type suspension means 6 is mounted in bearings in a suspension-sheave housing 17 with rectangular horizontal cross section, the horizontal cross section in the direction of the suspension sheave axles 18 having as small a width as possible and its length corresponding approximately to the diameter of the suspension sheave 9.2, 9.1. The thickness of the two walls 19 of the suspension-sheave housing 17, and the distances required between these and the suspension devices or means 6 arranged between them, are so chosen that the aforesaid width B of the horizontal cross section of the suspension-sheave housing does not exceed 150% of the width b of the suspension means and is ideally 135% to 140% of the width b of the suspension means.

Connected to the suspension-means housing 17 in its lower area is a tie-rod 20 which serves to fasten the suspension-sheave housing 17 and with it the suspension-sheave unit 8.2, 8.1 to the counterweight 2 and/or to the elevator car 1 and at the same time forms the aforementioned vertical axis 16 about which the suspension-sheave unit can be swiveled.

The connection between the suspension-sheave housing 17 and the tie-rod 20 is advantageously effected via a round pin 21 inserted in the suspension-sheave housing, as a result of which a certain articulation of the aforesaid connection is achieved. For at least part of its length, the tie-rod 20 is provided with an external thread which in conjunction with screw parts 26 not only allows screw connection with components of the counterweight 2 and/or the elevator car 1 but also serves to cause equal tensile forces in the parallel suspension means 6.

From FIG. 4 and FIG. 5 it can be seen that the flat-belt-type suspension means 6 can take the form of a V-ribbed belt of which at least one of the belt surfaces has a profile which comprises several parallel V-shaped ribs. In combination with a traction sheave and with suspension sheaves and diverter sheaves, whose periphery has a profile complementary to the profile of the belt, V-ribbed belts can be perfectly guided on the sheaves and assure the transmission of a higher tractive force between the traction sheave and suspension means than is possible with normal flat belts with identical surface materials.

FIGS. 6A and 7A are schematic and enlarged plan views of the arrangement shown in FIGS. 1 and 2 of the suspension-sheave units 8.2, 8.1 comprising suspension sheaves on the counterweight 2 and on the elevator car 1 respectively.

From FIGS. 6A and 7A the advantageous effects can be seen which can be obtained when the suspension-sheave systems consist of single suspension-sheave units 8.2, 8.1 which are swivelable about the vertical axis 16. Corresponding to FIGS. 1 and 2, 1.1.1 indicates the crosshead of the car frame 1.1 and 2 indicates the counterweight. The planes 6.1 running diagonally relative to the main horizontal axes 13 and 14 of the elevator car and counterweight respectively as shown in FIG. 2 in which the suspension means are arranged require a corresponding diagonal positioning of the suspension-sheave units 8.2, 8.1 comprising the suspension sheaves on the counterweight 2 and on the elevator car 1 respectively. The mutually separated and separately fastened suspension-sheave units 8.2, 8.1 allow their arrangement with their suspension-sheave axles 18 which in the direction of the planes 6.1 comprising the suspension means are mutually offset and therefore not only the arrangement of the suspension sheave of the counterweight 2 within the vertical projection of the counterweight but also the arrangement of the suspension sheaves of the elevator car 1 for example within the width of a relatively narrow crosshead 1.1.1 of the car frame of the car 1.

From FIG. 6A it can be seen that the swiveling motion of the suspension-sheave units 8.2, 8.1 is thereby limited, and that at a certain maximum swivel angle which depends on the distances between them, and therefore between the suspension means, these prevent each other from moving further.

The aforesaid distances are chosen in such manner that the suspension-sheave units 8.2, 8.1 in both directions of swivel can be swiveled by a maximum of 40° out of their central position, i.e. that these can be swiveled by a maximum of 80° in total.

If the angle between the parallel vertical planes 6.1, in which the suspension means are arranged, and the horizontal straight lines which run at right angles to the horizontal straight lines along which the vertical axes of the suspension means on the counterweight and/or on the elevator car are arranged are correspondingly small, the distances between the vertical axes (swiveling axes) 16 of the suspension-sheave unit 8.2, 8.1 can be so reduced that the suspension-sheave units can only be swiveled by a maximum of 30° out of their central position, i.e. they can be swiveled by a maximum of 60° in total. As a result, smaller distances between the suspension devices or means 6 can be achieved.

FIG. 6B demonstrates that suspension-sheave systems which comprise one monolithic suspension sheave 22 for all suspension means, or several suspension sheaves arranged on a common axle, occupy considerably more building space than the suspension-sheave systems 7.1, 7.2 according to FIG. 6A.

FIG. 7A shows an arrangement of the suspension-sheave units 8.2 mounted on the counterweight 2 in which the centers of the suspension-sheave units 8.2—which usually correspond with the vertical axes 16 about which the suspension-sheave units can be swiveled—are not arranged on the horizontal longitudinal axis 23 of the counterweight 2, but on a straight line 24 diagonal to this axis. It is easily seen that, with this measure, at a given distance between the suspension means—and therefore at certain distances between the suspension-sheave units—correspondingly larger angles $\alpha$ between the main axis 14 of the counterweight 2 and the main axis 13 of the elevator car 1 respectively and the vertical plane 6.1 in which the suspension means are arranged can be realized.

It can also be seen from FIG. 7B how much building space can be saved by use of the individual suspension-sheave units, each of which is swivelable about a vertical axis and movable in a horizontal plane. The suspension sheaves 22 shown in FIG. 7B which are monolithic, or consist of individual sheaves arranged on a common axle, occupy, even with the larger angle α shown here, substantially more space than the suspension-sheave units 8.2, 8.1 mounted in individually swivelable manner according to FIG. 7A. When modernizing existing elevator installations the use, for example, of suspension-sheave units according to the present invention can be the only possible way of placing the suspension sheave on the elevator car within the space available within the crosshead 1.1.1 of a car frame of the elevator car 1.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. In an elevator installation with an elevator car and a counterweight suspended and driven by a plurality of flat-belt-type suspension devices arranged in parallel, at least one of the counterweight and the elevator car having a suspension-sheave system that cooperates with at least one traction sheave and the suspension devices to form a suspension system with a reeving factor of at least 2:1, and center lines of the suspension devices being arranged in parallel vertical planes that run diagonal to a main horizontal axis of at least one of the counterweight and the elevator car, the suspension-sheave system comprising:

a suspension-sheave unit for each of the suspension devices, said suspension-sheave units being arranged adjacent to each other and each having at least one suspension sheave rotatably supported on an axle for engaging an associated one of the suspension devices; and a fastener for fastening said suspension-sheave units on one of the counterweight and the elevator car to orient said axles extending in a horizontal direction and to permit each said suspension-sheave unit to individually swivel about an associated vertical axis.

2. The elevator installation according to claim 1 wherein said suspension-sheave units are aligned to orient said axles to extend at right angles to the parallel vertical planes and are arranged offset relative to each other in the horizontal direction.

3. The elevator installation according to claim 1 wherein said suspension sheave of each of said suspension-sheave units is mounted in bearings in a suspension-sheave housing that has an essentially rectangular horizontal cross section and a maximum width measured in a direction of said axle of 150% of a width of the suspension devices.

4. The elevator installation according to claim 3 wherein the vertical axes about which said suspension-sheave units are swivelable are arranged along a straight line on the one of the counterweight and the elevator car and have distances between each other which are greater than the width of a horizontal cross section of said suspension-sheave housing such that said suspension-sheave units are swivelable about their vertical axes a maximum of 40° from their central position before they prevent each other from moving further.

5. The elevator installation according to claim 4 wherein the straight line along which the vertical axes of said suspension-sheave units are arranged run diagonal to a horizontal longitudinal axis of the one of the counterweight and the elevator car.

6. The elevator installation according to claim 3 wherein the vertical axes about which said suspension-sheave units are swivelable are arranged along a straight line on the one of the counterweight and the elevator car and have distances between each other which are greater than the width of a horizontal cross section of said suspension-sheave housing such that said suspension-sheave units are swivelable about their vertical axes a maximum of 30° from their central position before they prevent each other from moving further.

7. The elevator installation according to claim 6 wherein the straight line along which the vertical axes of said suspension-sheave units are arranged run diagonal to a horizontal longitudinal axis of the one of the counterweight and the elevator car.

8. The elevator installation according to claim 1 wherein each said fastener includes a tie-rod extending approximately vertically along the vertical axis about which said suspension-sheave unit is swivelable.

9. The elevator installation according to claim 8 wherein said tie-rod includes a section with an external thread, said external thread cooperating with screw parts having internal threads for adjusting tension in said associated suspension device when engaged with said suspension sheave.

10. The elevator installation according to claim 1 wherein the flat-belt-type suspension devices are V-ribbed belts engaging said suspension sheaves.

11. An elevator installation comprising::

an elevator car;

a counterweight;

a plurality of flat-belt-type suspension devices suspending said elevator car and said counterweight, center lines of said suspension devices being arranged in parallel vertical planes that run diagonal to a main horizontal axis of at least one of the counterweight and the elevator car;

a suspension-sheave unit for each of said suspension devices, said suspension-sheave units being arranged adjacent to each other and each having a suspension sheave rotatably supported on an axle for engaging an associated one of the suspension devices; and a fastener for fastening said suspension-sheave units on one of said counterweight and said elevator car to orient said axles extending in a horizontal direction and to permit each said suspension-sheave unit to individually swivel about an associated vertical axis.

12. The elevator installation according to claim 11 wherein said suspension-sheave units are mounted at an upper side of the one of said counterweight and said elevator car.

* * * * *